US008752733B2

(12) United States Patent
Rosaen

(10) Patent No.: US 8,752,733 B2
(45) Date of Patent: Jun. 17, 2014

(54) ROLLING APPARATUS

(76) Inventor: Lars Rosaen, Plymouth, MI (US)

( * ) Notice: Subject to any disclaimer, the term of this patent is extended or adjusted under 35 U.S.C. 154(b) by 216 days.

(21) Appl. No.: 13/095,510

(22) Filed: Apr. 27, 2011

(65) Prior Publication Data

US 2012/0277081 A1 Nov. 1, 2012

(51) Int. Cl.
*B65D 35/32* (2006.01)

(52) U.S. Cl.
CPC ..... *B65D 35/32* (2013.01)
USPC ..... 222/100

(58) Field of Classification Search
CPC ..... B65D 35/28; B65D 35/32; B65D 35/56; A61C 15/043; A61K 31/337; A61K 31/70
USPC ..... 222/100, 95, 99; 411/252, 100; 242/125, 315, 573.5, 578.1, 596.6
See application file for complete search history.

(56) References Cited

U.S. PATENT DOCUMENTS

| | | | | | |
|---|---|---|---|---|---|
| 1,575,386 | A | * | 3/1926 | Bandall | 222/93 |
| 1,770,946 | A | | 7/1930 | Rostiser | |
| 1,797,727 | A | * | 3/1931 | La Spisa | 222/97 |
| 2,089,004 | A | * | 8/1937 | Schwertner | 222/100 |
| 2,531,060 | A | * | 11/1950 | Krueger | 222/99 |
| 2,551,909 | A | * | 5/1951 | Soileau | 222/97 |
| 2,851,195 | A | * | 9/1958 | Widmann | 222/100 |
| 2,896,822 | A | * | 7/1959 | Songer | 222/99 |
| 3,880,328 | A | * | 4/1975 | Leeson | 222/100 |
| 3,885,708 | A | * | 5/1975 | Parry | 222/100 |
| 3,920,157 | A | * | 11/1975 | Yeung | 222/100 |
| 4,570,828 | A | * | 2/1986 | Wood | 222/100 |
| 4,576,314 | A | * | 3/1986 | Elias et al. | 222/97 |
| 5,097,987 | A | * | 3/1992 | Liberatore | 222/1 |
| 5,102,014 | A | * | 4/1992 | Yanagisawa et al. | 222/100 |
| 5,215,223 | A | * | 6/1993 | Lee | 222/100 |
| 5,642,839 | A | * | 7/1997 | Lee | 222/99 |
| 5,685,457 | A | * | 11/1997 | Liberatore | 222/100 |
| 5,884,812 | A | * | 3/1999 | Stawowski | 222/100 |
| 5,960,994 | A | * | 10/1999 | Liberatore | 222/100 |
| 6,247,618 | B1 | * | 6/2001 | Liberatore | 222/100 |
| 7,837,068 | B2 | * | 11/2010 | Liberatore | 222/100 |
| 8,096,447 | B2 | * | 1/2012 | Liberatore | 222/100 |
| 8,302,815 | B2 | * | 11/2012 | Gashi | 222/100 |
| 2007/0056987 | A1 | * | 3/2007 | Liberatore | 222/100 |
| 2009/0302054 | A1 | * | 12/2009 | Cragnolini | 222/1 |
| 2009/0321477 | A1 | * | 12/2009 | Baca | 222/100 |

* cited by examiner

*Primary Examiner* — Kevin P Shaver
*Assistant Examiner* — Michael J Melaragno
(74) *Attorney, Agent, or Firm* — Gifford, Krass, Sprinkle, Anderson & Citkowski, P.C.

(57) ABSTRACT

A roller apparatus for dispensing the contents of a flexible tube may include a housing, a shaft and a cap. The shaft being positioned in the housing and mounted to thereto by rotation in a clockwise or counterclockwise direction. The shaft may then be enclosed in the housing by placement of a cap on the housing that also functions to engage an end of the shaft. Following insertion of the sealed end of a flexible tube though openings in the housing and the shaft, the tube is taken up into the housing by further rotation of the cap, and thus the shaft. To remove the tube, the cap may be counter rotated to release the shaft (and the tube now wrapped around the shaft) from the housing.

12 Claims, 3 Drawing Sheets

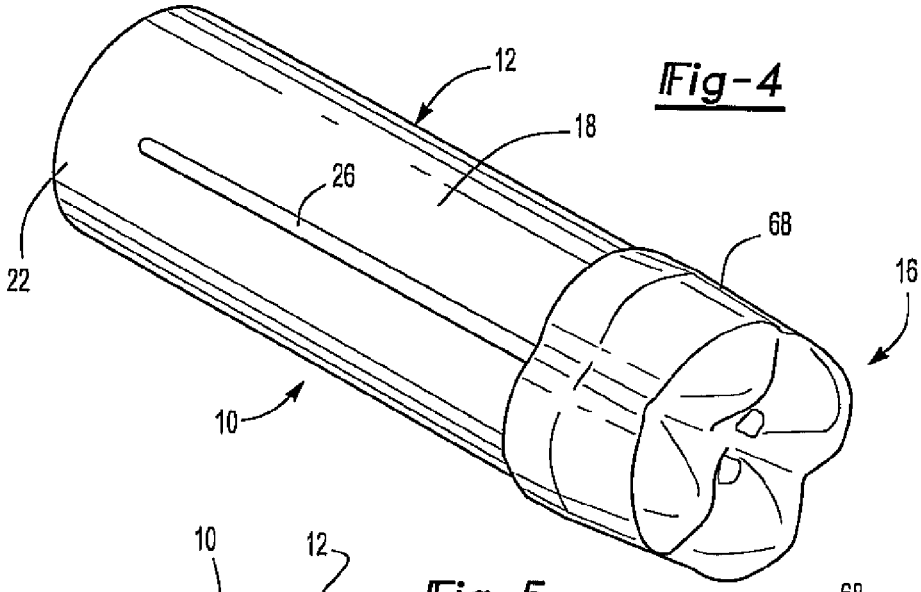
Fig-4
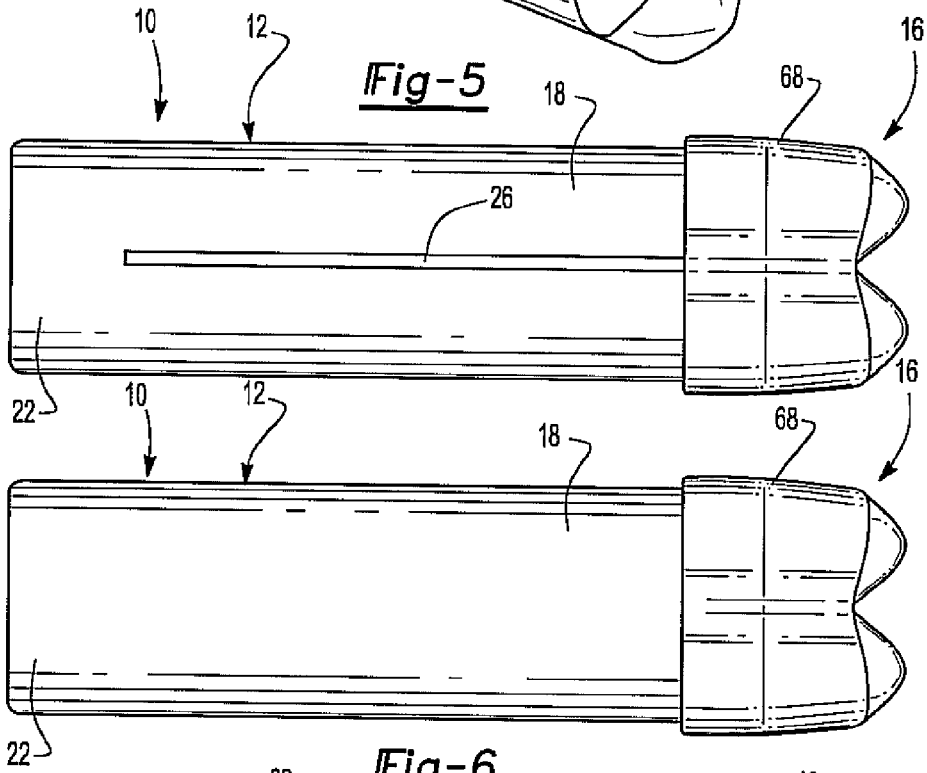
Fig-5
Fig-6
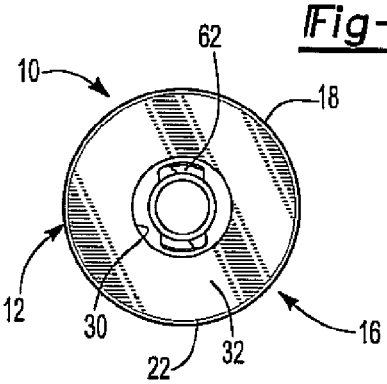
Fig-7
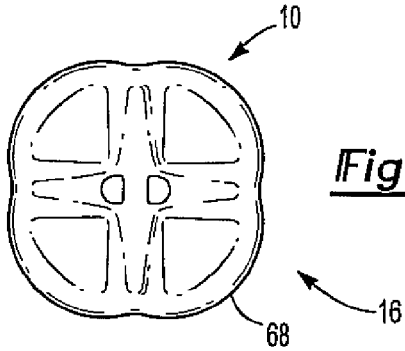
Fig-8

ROLLING APPARATUS

CROSS-REFERENCE TO RELATED APPLICATIONS

Not applicable.

FIELD OF THE INVENTION

A roller apparatus is disclosed that may be used for dispensing material from a flexible walled tube. The roller apparatus may, for example, be configured to dispense toothpaste from its tube.

BACKGROUND OF THE INVENTION

Since the creation of the flexible walled tube, their have been some that have had a need to squeeze the last possible drop of material from each tube. To assist with this goal, in 1928 E. L. Rostier received U.S. Pat. No. 1,770,946, which disclosed a key for collapsible folding tubes. Then in 1950, A. A. F. Kruger was issued U.S. Pat. No. 2,531,060 for an adapter for collapsible tube winding. Kruger's adapter included a housing into which an associated winding key (fitted to the end of a flexible tube) could be inserted and easily rotated. In 2001, Liberatore received U.S. Pat. No. 6,247,618 for a roll-up tube dispenser with shell housing. In Liberatore, the adapter like housing had a clam-shell design that allowed a key to be easily inserted into the housing.

SUMMARY OF THE INVENTION

A roller apparatus that may be used for efficiently dispensing the contents of a flexible tube may include a housing, a shaft and a cap. The housing may be a tubular shaped housing having a wall, an open first end, and a second end. The wall of the housing may define an open interior space and include a channel that extends through the wall and runs from the first end longitudinally along the housing toward the second end. This channel may be dimensioned to receive a sealed end of a flexible tube. The second end of the housing may include an aperture having a threaded wall.

The shaft of the apparatus may define an opening that extends longitudinally along the body of the shaft. The opening of the shaft may be aligned with the channel of the housing when the shaft is positioned in the housing, and dimensioned to receive the sealed end of the flexible tube. The shaft may also include one end having a pin and an opposite end having a base, and a post extending from the base. The post may include an unthreaded portion proximate the base and an unthreaded portion.

The cap of the apparatus may be configured to be rotatably mounted on the first end of the housing and operate to engage the pin of the shaft. The cap may thus function to assist in retaining the shaft within the housing and allow a user may rotate the shaft by rotation of the cap.

BRIEF DESCRIPTION OF THE DRAWINGS

Reference will be made herein to the associated drawings wherein like reference numbers refer to like parts throughout, and in which:

FIG. 4. is a further perspective view of the embodiment of the roller apparatus shown in FIG. 1

FIG. 5 is a planar view of one side of the embodiment of the roller apparatus shown in FIG. 1;

FIG. 6 is a planar view of an opposite side of the embodiment of the roller apparatus shown in FIG. 1;

FIG. 7 is a planar view of one end of the embodiment of the roller apparatus shown in FIG. 1; and FIG. 8 is a planar view of an opposite end of the embodiment of the roller apparatus shown in FIG. 1;

DETAILED DESCRIPTION OF THE PREFERRED EMBODIMENTS

Figure 1:
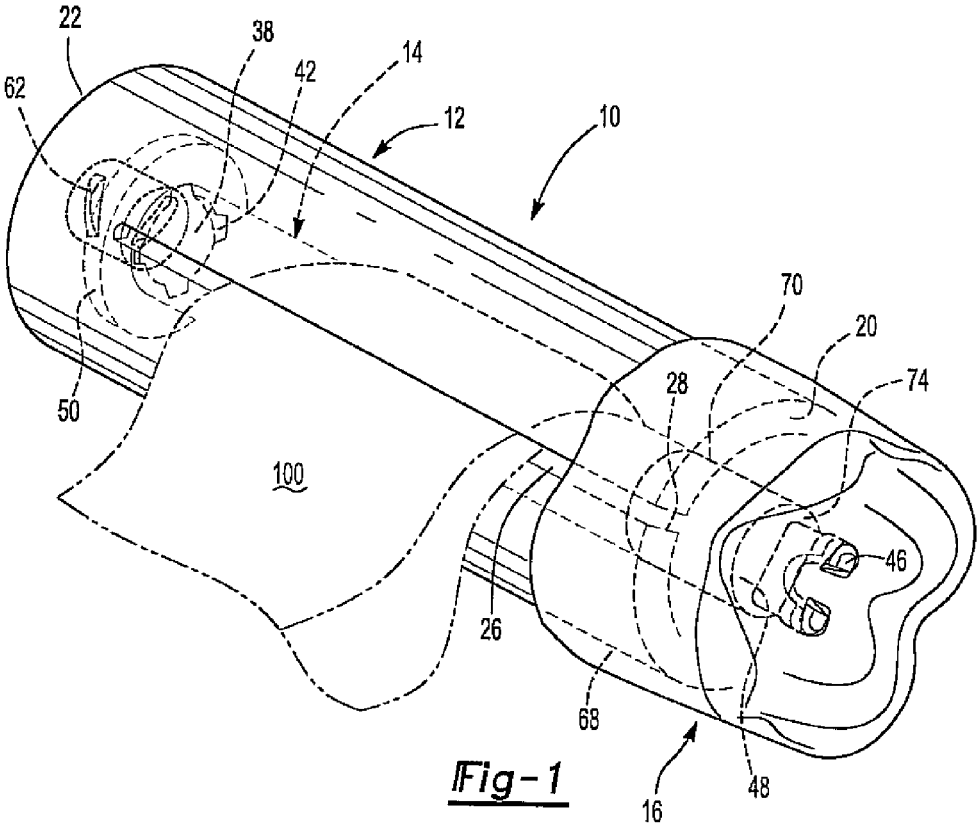
FIG. 1 is a perspective view of an embodiment of a roller apparatus constructed in accordance with the present invention, showing an end of a flexible tube and other elements in phantom.

Referring now to FIG. 1-8, a roller apparatus 10 for a flexible tube 100 may include a housing 12, a shaft 14 and a cap 16. The roller apparatus 10 may be configured to allow the flexible tube 100 to be manually reeled in or taken up into the housing 12—starting with a sealed end of the tube 100—to assist a user in efficiently dispensing material from the tube 100.

Still referring to FIGS. 1-8, the housing 12 may have a generally tubular shape or construction that may included a wall 18, a first end 20, and a second end 22. The wall 18 may define an open interior space 24 for the housing 12 and further define a channel 26 that extends from the first end 20 (so that an end 28 of the channel 26 is open) to proximate the second end 22. Also, as will be explained further below, the channel 26 may be dimensioned to receive the sealed end of a flexible tube 100.

Figure 3:
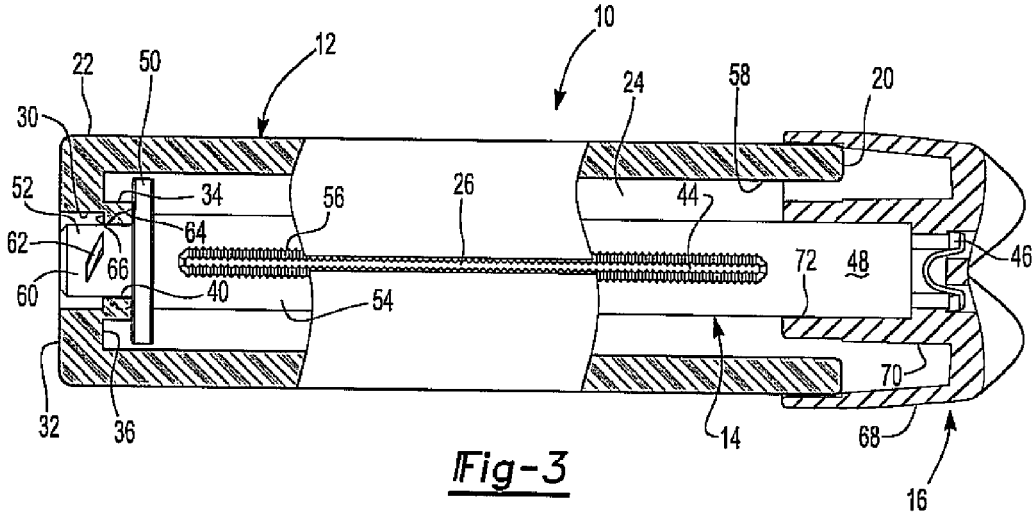
FIG. 3 is a planar side, partial cutaway, view of the embodiment of the roller apparatus shown in FIG. 1.

Still referring to FIGS. 1-8, the first end 20 may be open to permit access into the open interior space 24 of the housing 12. The second end 22 may include a recess 30 defined on an exterior face 32 of the second end 22 and a support 34 positioned on a floor 36 (e.g., a raised portion of the floor 36) of the interior 24 of housing 12. An aperture 38 may also be defined through the recess 30 and support 34, with the aperture 38, support 34 and recess 30 each being aligned with and/or be concentric to a longitudinal axis (not shown) of the housing 12. As best shown in FIG. 3, a face or wall 40 of the aperture 38 may include one or more threads 42 that, as will be discussed below, may be engaged by the shaft 14.

Still referring to FIGS. 1-8, the housing 12 may be molded or milled from polymer materials known in the art. Additionally, in the disclosed embodiment the housing 12 is illustrated as having cylindrical construction. It will be appreciated, however, that the housing 12 may also be constructed in a square, rectangular, oval, polygonal (e.g., hexagonal, pentagonal) design.

Figure 2:
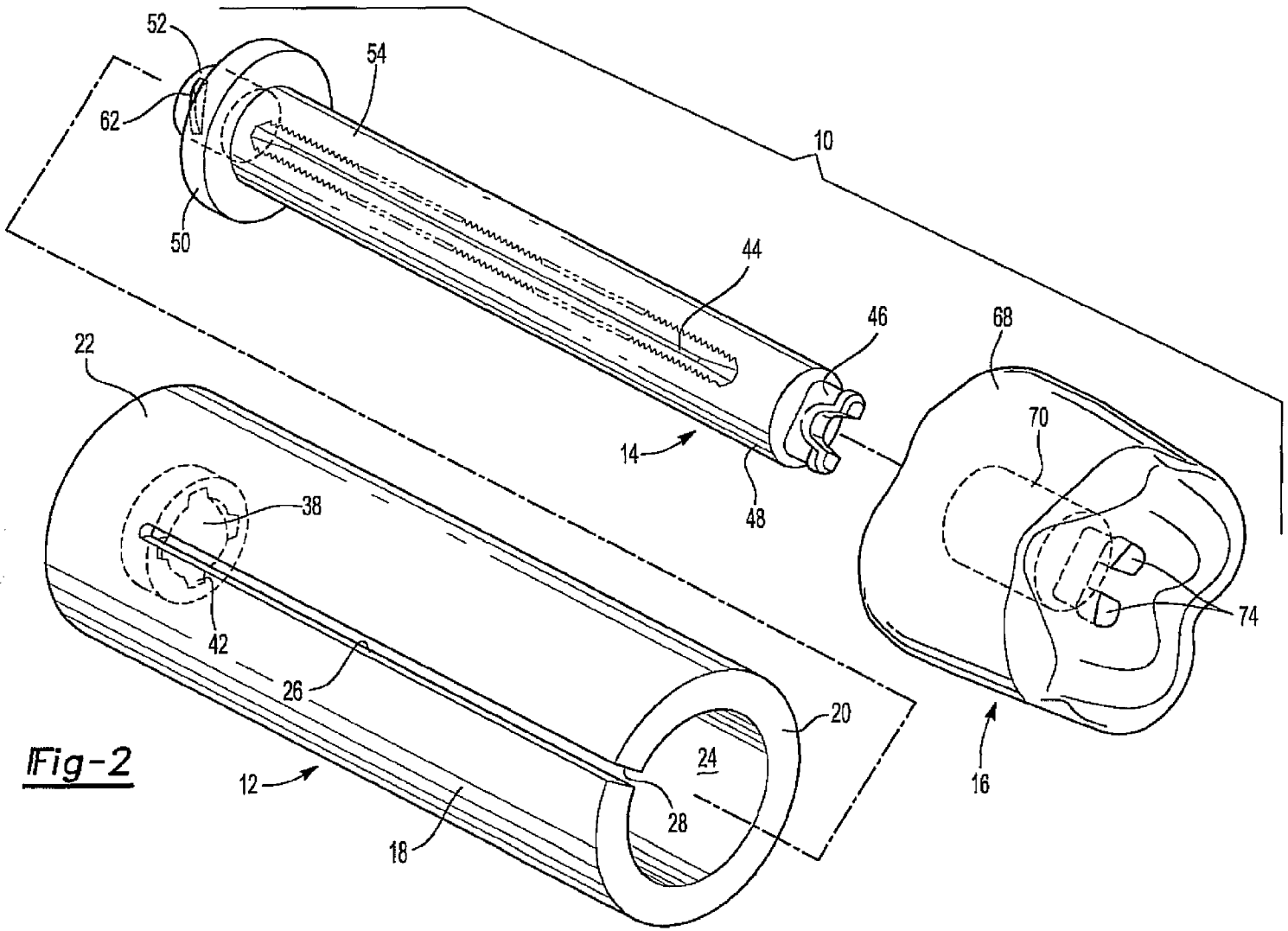
FIG. 2 is a exploded perspective view of the embodiment of the roller apparatus shown in FIG. 1.

Still referring to FIGS. 1-8, and as best shown in FIGS. 1-3, the shaft 14 may define an longitudinally extending aperture or opening 44 and include including a pin 46 at one end 48, with a base 50 and post 52 at an opposite end 54. The aperture 44 of the shaft 14, like the channel 26 of the housing 12, may be dimensioned to receive the sealed end of the flexible tube 100. And, to that end, when the shaft 14 is positioned within the housing 12 it will be appreciated that the aperture 44 of the shaft 14 may be aligned with the channel 26 to receive the end of the tube 100. As best shown in FIG. 3, the aperture 44 of the shaft 14 may also include a serrated portion 56. In operation, this serrated portion 56 may function to grip the sealed end of the flexible tube 100 to better allow the shaft 14 to "reel-in" the tube 100.

Looking now at FIGS. 1-3, the pin 46 of the shaft 14 may extend axially from the one end 48 of the shaft 14. The pin 46 may function to allow the shaft 14 to engage and be rotated by the cap 16. And, as best shown in FIG. 3, the base 50 of the shaft 14 may rest on the support 34 have a circular or "disk-like" construction with a diameter that is less than an inside diameter of the interior 24 of the housing 12. Further, it will be appreciated that a base 50 with sufficient predetermined diameter may function to stop the shaft 14 from passing through the aperture 38 at the second end 22 and center the shaft 14 within the housing 12 interior 24. Centering of the shaft 14 within the housing 12 allows the portion of the shaft 14 including the shaft aperture 38 to be spaced from an interior face 58 of the wall 18 (and thereby create room with the interior 24 for up-take of the flexible tube 100, see FIG. 1).

Still referring to FIGS. 1-3, the post 52 may axially extend from the base 50 and include an unthreaded portion 60 proximate the base 50 and a threaded portion 62. As best shown in FIG. 3, the distance between the threaded portion 62 and the base 50 may be larger than a distance from a top 64 of the support 34 to a floor 66 of the recess 30 of the second end 22. As a result, the shaft 14 may be mounted to the housing 12 by threading the post 52 through the aperture 38 at the second end 22 of the housing until the threaded portion 62 extends into the recess 30. When in this orientation, it will be appreciated that the shaft 14 may be further rotated in the first direction and remain in the housing 12, but rotation in a second direction permits the threaded portion 62 to reengage the aperture wall 40 and allow the shaft 14 to be backed out from the housing (e.g., removed).

Referring now to FIGS. 1-8, the shaft 14 may be molded or milled from polymer materials known in the art. Additionally, in the disclosed embodiment the shaft 14 is illustrated as having cylindrical construction. It will be appreciated, however, that the shaft 14 may also be constructed in a square, rectangular, oval, polygonal (e.g., hexagonal, pentagonal) design.

Referring now to FIGS. 1-5 and 7, the cap 16 may be configured to be rotatably mounted on the first end 20 of the housing 12 and include an exterior wall 68 and an interior wall 70. As best shown in FIG. 3, the exterior wall 68 may be configured to removably engage the first end 20 of the housing 12. The interior wall 70 may define a recess 72 dimensioned to receive the end 48 of shaft 14 having the pin 46. A top of the cap 16 and/or a floor of the recess 72 of the cap 16 may include an aperture 74 configured to receive and engage the pin 46 so that, in operation, the rotation of the cap 16 may result in rotation of the shaft 14.

Referring to FIGS. 1-6 and 8, the cap 16 may be molded or milled from polymer materials known in the art. Additionally, in the disclosed embodiment the cap 16 is illustrated as having the general ornamental shape of a human molar. It will be appreciated, however, that the cap 16 may also be constructed in a square, rectangular, oval, polygonal (e.g., hexagonal, pentagonal) design.

In operation, the shaft 14 may be inserted into the housing 12 and then rotated in a first direction so that the post 52 threads through the aperture 38 in the second end 22. The cap 16 may then be placed over the first end 20 and engage the opposite end 54 of the shaft 14. Next, the sealed end of a flexible tube 100 may be passed through the channel 26 and into the aligned aperture 44 of the shaft 14. Once engaged, the tube 100 may be taken up/reeled in by the shaft 14 as a result of the further rotation of the cap 14 in the first direction. To remove the tube 100 from the housing 12, the cap 16 may be rotated in the opposite or second direction to cause the post 52 to thread back through the aperture 38 and release the shaft 14 from the housing 12.

Having described an embodiment of a roller apparatus, various other embodiment will become apparent to those of skill in the art that do not depart from the scope of the invention as claimed.

I claim:

1. A roller apparatus consisting of:

a tubular housing, a shaft received within the housing, and a cap, the housing including a wall, an open first end, and a second end, the wall defining an open interior space for the housing and having a channel therethrough that extends from the first end to proximate the second end, the channel being dimensioned to receive a sealed end of a flexible tube, the second end defining an aperture having a threaded wall, the shaft defining a longitudinally extending aperture and including a pin extending axially from one end, with an opposite end having a base and post extending from the base, the post including an unthreaded portion proximate the base and a threaded portion, the aperture in the shaft being alignable with the channel of the housing and dimensioned to receive the sealed end of the flexible tube; and the cap configured to be rotatably mounted on the first end of the housing and receiving the pin of the shaft so that the shaft is retained within the housing between the cap and the second end of the housing and the shaft is rotated by rotation of the cap, with the cap being configured and positioned on the housing so that the cap may be turned in either a clockwise or counterclockwise direction.

2. The roller apparatus of claim 1, wherein the aperture of the shaft is defined by a wall having a serrated portion.

3. The roller apparatus of claim 1, wherein the cap further consists of an exterior wall and an interior wall.

4. The roller apparatus of claim 3, wherein the exterior wall is configured to engage the first end of the housing.

5. The roller apparatus of claim 4, wherein the interior wall defines a recess dimensioned to receive the shaft, with the recess including a floor.

6. The roller apparatus of claim 5, wherein the floor of the recess defines an aperture dimensioned to receive the pin of the shaft.

7. The roller apparatus of claim 1, wherein the second end of the housing defines an exterior recess having a floor, the floor of the recess including the aperture of the housing having the threaded wall, whereby the post of the shaft is threaded through the aperture to extend into the recess.

8. A roller apparatus consisting of:

a housing, a shaft received within the housing, and a cap, the housing including an housing having a wall, an open first end, and a second end, the wall defining an open interior space for the housing and having a channel therethrough that extends from the first end to proximate the second end, the channel being dimensioned to receive a sealed end of a flexible tube, the second end defining an exterior recess, and the recess of the second end including a floor defining an aperture having a threaded wall and extending into the interior space of the housing, the shaft defining a longitudinally extending aperture having a serrated wall portion and including a pin extending from one end, with an opposite end having a base and post extending from the base, the post including an unthreaded portion proximate the base and a threaded portion, with the post of the shaft being threaded through the aperture at the second end of the housing to extend into the recess, and the aperture in the shaft being alignable with the channel of the housing and dimensioned to receive the sealed end of the flexible tube; and the cap configured to be rotatably mounted on the first end of the housing and receiving the pin of the shaft so that the shaft is retained within the housing between the cap and the second end of the housing and the shaft is rotated by rotation of the cap, with the cap being configured and positioned on the housing so that the cap may be turned in either a clockwise or counterclockwise direction.

9. The roller apparatus of claim 8, wherein the cap further consists of an exterior wall and an interior wall.

10. The roller apparatus of claim 9, wherein the exterior wall is configured to engage the first end of the housing.

11. The roller apparatus of claim 10, wherein the interior wall defines a recess dimensioned to receive the shaft, with the recess including a floor.

12. The roller apparatus of claim 11, wherein the floor of the recess defines an aperture dimensioned to receive the pin of the shaft.

* * * * *